US007454883B2

(12) United States Patent
Hoyt et al.

(10) Patent No.: US 7,454,883 B2
(45) Date of Patent: Nov. 25, 2008

(54) DEVICE, KIT AND METHOD FOR USE IN HANDLING CONTAINERS

(75) Inventors: Robert Q. Hoyt, 3000 E. Ina Rd., Tucson, AZ (US) 85718; Frank Tinker, Tucson, AZ (US)

(73) Assignee: Robert Q. Hoyt, Carson City, NV (US)

( * ) Notice: Subject to any disclaimer, the term of this patent is extended or adjusted under 35 U.S.C. 154(b) by 151 days.

(21) Appl. No.: 11/504,403

(22) Filed: Aug. 15, 2006

(65) Prior Publication Data

US 2007/0084820 A1 Apr. 19, 2007

Related U.S. Application Data

(60) Provisional application No. 60/709,172, filed on Aug. 18, 2005.

(51) Int. Cl.
*B65B 31/04* (2006.01)
*B67B 7/46* (2006.01)

(52) U.S. Cl. ..... 53/510; 53/431; 81/3.31

(58) Field of Classification Search ..... 53/428, 53/431, 432, 111 R, 510, 84; 81/3.2, 3.31
See application file for complete search history.

(56) References Cited

U.S. PATENT DOCUMENTS

| | | | | | |
|---|---|---|---|---|---|
| 1,275,228 | A * | 8/1918 | Crowe | 81/3.2 |
| 2,729,124 | A * | 1/1956 | Farandatos | 81/3.2 |
| 3,192,803 | A * | 7/1965 | Federighi | 81/3.2 |
| 4,188,457 | A | 2/1980 | Throp | |
| 4,317,390 | A * | 3/1982 | Nakayama | 81/3.2 |
| 4,464,956 | A * | 8/1984 | Hashimoto | 81/3.2 |
| 4,475,576 | A * | 10/1984 | Simon | 141/98 |
| 4,694,850 | A * | 9/1987 | Fumino | 137/318 |
| 4,791,834 | A * | 12/1988 | Federighi | 81/3.2 |
| 5,020,395 | A * | 6/1991 | Mackey | 81/3.2 |
| 6,477,920 | B1 * | 11/2002 | Yang | 81/3.2 |
| 6,502,481 | B1 * | 1/2003 | Lin | 81/3.2 |
| 6,622,595 | B1 * | 9/2003 | Federighi | 81/3.48 |
| 7,032,364 | B2 * | 4/2006 | Yoshida et al. | 53/432 |
| 7,231,850 | B2 * | 6/2007 | Wang | 81/3.2 |
| 7,255,022 | B1 * | 8/2007 | Rivera | 81/3.2 |
| 7,299,601 | B2 * | 11/2007 | Yoshida et al. | 53/264 |
| 2006/0191242 | A1 * | 8/2006 | Yoshida et al. | 53/510 |

OTHER PUBLICATIONS

Advertisement: The Sharper Image—Vincci Wine Opener & Vacuum Sealer (1 page).
Advertisement: Beverage Factory—Epicurean Wine Preservation System (3 pages).

* cited by examiner

*Primary Examiner*—Paul R Durand
(74) *Attorney, Agent, or Firm*—Antonio R. Durando

(57) ABSTRACT

A device for removing a closure from a container includes a hollow needle, a piston for driving the needle into the closure and a compressed gas cartridge for driving the piston. Once the needle has been driven into the closure so that an end of the needle is inside the container, the piston can reciprocate to force air through the needle and pressurize the container in order to eject the closure. The piston can also reciprocate to evacuate air from the container through a stopper with a check valve when leftover contents of the container are to be preserved.

29 Claims, 5 Drawing Sheets

DEVICE, KIT AND METHOD FOR USE IN HANDLING CONTAINERS

RELATED APPLICATIONS

This application is based on U.S. Provisional Application No. 60/709,172, filed Aug. 18, 2005.

BACKGROUND OF THE INVENTION

1. Field of the Invention

The invention relates to the handling of containers.

2. Description of the Prior Art

Certain types of sealed containers require specialized implements to access the contents of the containers. For example, many wine bottles are sealed with corks which cannot simply be removed with the fingers and different implements for cork removal have been developed.

The oldest and most common implement for the removal of corks is the corkscrew which comes in various designs. Although corkscrews work well for those who use them on a regular basis, corkscrews present problems for the occasional user. Occasional users tend to misalign corkscrews thereby making it difficult to insert the corkscrews in corks. A misaligned corkscrew can also damage a cork in such a way that the cork can no longer be removed with the corkscrew.

A more recent device for the removal of corks consists of a small hand pump having a piston which rides in a cylinder. An opening in the side of the cylinder can receive a needle-like element resembling those used for the inflation of balls. The needle-like element has a passage which runs the length of the needle-like element and is open at either end of the needle-like element. When the needle-like element is attached to the hand pump cylinder and the hand pump is operated, the piston forces air through the needle-like element during the downstroke of the piston.

Assuming that a cork is to be removed from a wine bottle, the needle-like element is manually forced through the cork so that the end of the needle-like element remote from the cylinder is located inside the bottle. The hand pump is then operated to pressurize the interior of the bottle to such a degree that the cork is expelled from the bottle.

The hand pump comes with stoppers which can be used to cap the bottle if the contents of the bottle are not consumed completely and it is desired to retain the remainder of the contents for future consumption. Each of the stoppers has a pair of channels, and each channel contains a check valve which, when the stopper is in place, allows air to flow out of the bottle but not into the bottle.

The end of the hand pump cylinder has two openings which can be aligned with the channels in the stoppers. After the partially emptied bottle has been capped with one of the stoppers, the openings in the end of the cylinder are placed in register with the channels in the stopper. The hand pump is thereafter operated, and air is evacuated from the bottle during each upstroke of the piston. The resulting vacuum in the bottle inhibits oxidation of the remaining contents of the bottle so that freshness and flavor are preserved for some period of time.

When the needle-like element is attached to the hand pump, the needle-like element projects from the hand pump and can impact objects as well as people. Moreover, since insertion of the needle-like element into a cork to be removed is performed manually, a great deal of effort is required. Care must also be taken not to force the cork into the bottle during insertion of the needle-like element into the cork.

Also known is a battery-operated pump for evacuating a wine bottle via a stopper equipped with a check valve. Unlike the hand pump described above, the battery-operated pump is not designed to remove corks from bottles.

SUMMARY OF THE INVENTION

One aspect of the invention resides in a device for use in handling containers.

According to one embodiment, the container handling device comprises a holder which is provided with a passage having an open passage end. This embodiment of the device further comprises a piercing element which has a piercing end and is receivable in the passage in a retracted position. The piercing element is designed so that the piercing element is located in the passage substantially in its entirety when the piercing element is in the retracted position. The present embodiment of the container handling device additionally comprises means for driving the piercing element from the retracted position to an extended position. In the extended position, the piercing element projects from the passage through the open passage end and the piercing end of the piercing element is located externally of the passage to permit penetration of a container by the piercing end.

In accordance with another embodiment, the container handling device comprises a holder provided with a passage, and a piercing element which has a piercing end and is receivable in the passage in a retracted position. This embodiment of the device further comprises means for driving the piercing element from the retracted position to an extended position in which the piercing end can penetrate a container. The driving means here includes a movable element for urging the piercing element from the retracted position to the extended position. Furthermore, the holder is provided with means for positioning and retaining a cartridge of compressed gas on the holder. The holder is also provided with a conduit for conducting compressed gas from the cartridge to the movable element of the driving means so that the compressed gas can displace the movable element and thereby cause the movable element to shift the piercing element from the retracted position to the extended position.

The conduit may have an open conduit end, and the positioning and retaining means can then include a seal in the region of the open conduit end for receiving and establishing a seal with an end portion of the cartridge.

A puncturing element for puncturing the cartridge may be disposed in the conduit.

The movable element of the driving means may be disposed in the holder passage and, in such an event, the movable element can be arranged so that the movable element is located between the conduit and the piercing element when the piercing element is likewise in the passage. Here, the movable element may be provided with sealing means for inhibiting gas flow past the movable element.

A manually operable element may be provided for controlling gas flow through the conduit. The manually operable element can be designed to be switched into and out of a condition in which gas flow from the cartridge positioning and retaining means to the movable element is blocked.

The holder passage in the first-mentioned embodiment of the container handling device has an open end, and a sealing element may circumscribe this open end. The holder passage in the second-mentioned embodiment can also have an open end and, under such circumstances, the open passage end in the second-mentioned embodiment can also be circumscribed by a sealing element.

Both embodiments of the container handling device may comprise a guard for the piercing end of the piercing element, and the piercing end can be embedded in the guard when the piercing element is in its retracted position. The guard may include means for sealing the holder passage against gas flow past the guard.

In either embodiment of the container handling device, the piercing element can be provided with a channel for conveying gaseous fluid through the piercing element. This channel may have an open first channel end in the region of the piercing end of the piercing element. The channel may further have an open second channel end which is arranged to be located in the holder passage when the piercing element is in its extended position. A check valve can be mounted in the channel for inhibiting gas flow in a direction from the first channel end towards the second channel end.

As indicated earlier, the driving means of the second-mentioned embodiment of the container handling device comprises a movable element for urging the piercing element from its retracted position to its extended position. Such a movable element may be present in the first-mentioned embodiment of the container handling device as well.

The movable element can be designed not only to urge the piercing element from the retracted position to the extended position but also to force gaseous fluid through the channel of the piercing element when the latter is in the extended position.

The holder in both the first-mentioned and second-mentioned embodiments of the container handling device can be provided with an outlet duct for evacuating gaseous fluid from the holder passage during movement of the piercing element from its retracted position to its extended position. In such an event, the piercing element may be provided with means for isolating the movable element from the outlet duct when the piercing element is in the extended position. A check valve can be mounted in the outlet duct for inhibiting gas flow into the holder passage via the outlet duct.

In either embodiment of the container handling device, the holder can be provided with an inlet duct for admitting gaseous fluid into the holder passage. Here, the movable element of the driving means may be designed to draw gaseous fluid through the inlet duct when the piercing element is in its extended position. The inlet duct can be equipped with a check valve for inhibiting gas flow out of the holder passage via the inlet duct.

Another aspect of the invention resides in a kit for use in handling containers. The kit comprises a holder provided with a passage, and a piercing element which has a piercing end and is receivable in the passage in a retracted position. The kit additionally comprises means for driving the piercing element from the retracted position to an extended position in which the piercing end can penetrate a container. The driving means includes a movable element for urging the piercing element from its retracted position to its extended position. The driving means also includes a cartridge for supplying compressed gas to the movable element so as to displace the movable element and thereby cause the movable element to shift the piercing element from the retracted position to the extended position. The holder is provided with means for positioning and retaining the cartridge on the holder, and the holder is further provided with a conduit for conducting compressed gas from the cartridge to the movable element.

The kit can also comprise a closure for a container, and such closure may include a body which is provided with a closure passage and comprises oxygen-scavenging material. A check valve can be mounted in the closure passage.

An additional aspect of the invention resides in a method of handling containers.

According to one embodiment, the method comprises the steps of inserting a piercing element in a passage substantially in its entirety, positioning a container and the piercing element next to one another, and driving at least one portion of the piercing element out of the passage and into the container.

In accordance with another embodiment, the method comprises the steps of positioning a container and a piercing element next to one another, and driving at least one portion of the piercing element into the container using compressed gas.

In either of the preceding embodiments of the method, the portion of the piercing element driven into the container may have a piercing end which is embedded in a guard during the positioning step. Both of these embodiments of the method can then comprise the step of guiding such portion of the piercing element with the guard during the driving step.

Either of the foregoing embodiments of the method may further comprise the step of admitting gaseous fluid into the container through the piercing element following the driving step. If the container is provided with a closure, the admitting step can include pressurizing the container sufficiently to expel the closure therefrom. The admitting step may be performed using compressed gas discrete from the gaseous fluid admitted into the container.

Both of the preceding embodiments of the method can additionally comprise the steps of opening the container following the driving step, closing the container and mechanically evacuating gaseous fluid from the container following the closing step. Similarly to the admitting step, the evacuating step may be performed using compressed gas.

Either of the foregoing embodiments of the method can also comprise the step of chemically removing oxygen from the container subsequent to the closing step.

In the first-mentioned embodiment of the method, compressed gas can again be used in the performance of the driving step.

According to an additional embodiment, the method comprises the steps of providing a container having a closure, providing a passage having an opening and introducing gas into the interior of the container through the opening to pressurize the interior of the container and thereby expel the closure from the container. This embodiment of the method further comprises the steps of closing the container and evacuating gas from the interior of the container through the opening in the passage.

Additional features and advantages of the invention will be forthcoming from the following detailed description of certain specific embodiments when read in conjunction with the accompanying drawings.

DESCRIPTION OF THE PREFERRED EMBODIMENTS

Figure 1:
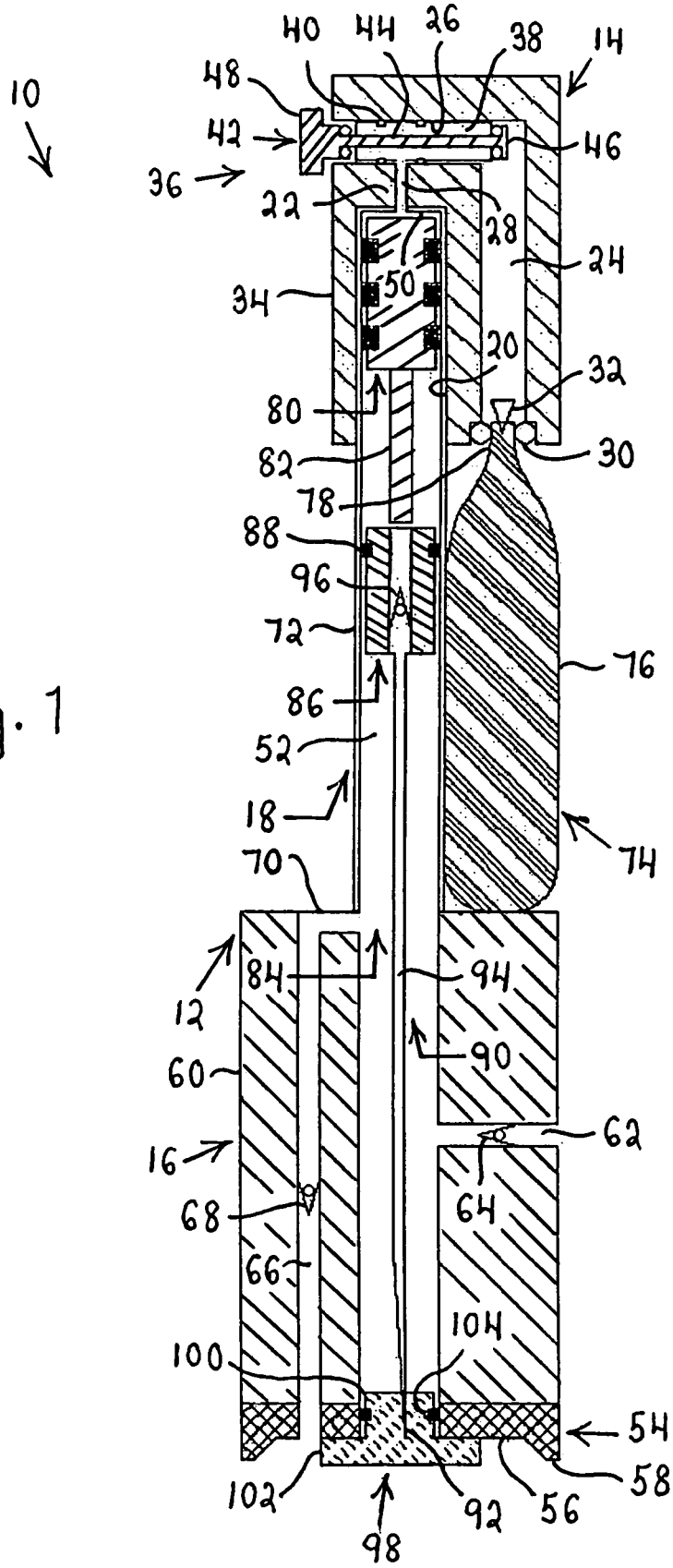
FIG. 1 is a primarily longitudinal sectional view of a device according to the invention for use in handling containers.

Referring to FIG. 1, the numeral 10 identifies a device in accordance with the invention for use in handling containers. The container handling device 10 includes a holder or holding means 12 which comprises a head piece 14, a tail piece 16 spaced from the head piece 14 and a connecting piece 18 which joins the head piece 14 and the tail piece 16 to one another. The head piece 14 can also be referred to as a valved cylinder/cartridge coupler while the tail piece 16 can be referred to as a container/cylinder coupler.

The head piece 14 is here in the form of a cylinder of circular transverse cross section. The head piece 14 is formed with a recess 20 which extends in axial direction of the head piece 14 and has opposite ends. The recess 20, which is of circular transverse cross section, is bounded at one end by an end wall 22. The other end of the recess 20 has an opening which receives the connecting piece 18.

The head piece 14 is further provided with a conduit having a section 24 which runs parallel to the recess 20 and a section 26 which runs perpendicular to the section 24. The conduit also has a section 28 which branches off from the conduit section 26 and runs through the end wall 22 parallel to the conduit section 24. The conduit section 24, conduit section 26 and conduit section 28 are assumed to be of circular transverse cross section. The conduit section 24 and conduit section 26 have the same diameter or cross-sectional area while the conduit section 28 has a substantially smaller diameter or cross-sectional area than the conduit sections 24,26. The conduit section 28 opens into the recess 20.

The conduit section 24 has an end disposed next to that end of the recess 20 where the connecting piece 18 enters the recess 20. This end of the conduit section 24 is formed with an opening, and an annular seal 30 is mounted in the opening.

A piercing lance or puncturing element 32 is positioned inside the conduit section 24 adjacent to the annular seal 30, and the lance 32 has a piercing or puncturing end which is in the form of a sharp point and faces the seal 30. The seal 30 defines a passage which connects the exterior of the conduit section 24 to the interior thereof, and the piercing end of the lance 32 is in line with the center of this passage and may be located in the passage.

The head piece 14 has an outer peripheral surface 34, and the conduit section 26 runs from the conduit section 24 past the conduit section 28 and to the outer peripheral surface 34. A manually operable valve or flow control element 36 is mounted in the conduit section 26. The manually operable valve 36 includes a valve body 38 of circular transverse cross section which is fixed in the conduit section 26 and extends from the conduit section 24 to a location between the conduit section 28 and the outer peripheral surface 34. An annular seal 40 circumscribes the valve body 38 on either side of the conduit section 28 to prevent gas flow past the body 38.

The manually operable valve 36 further includes an actuating member 42 which comprises a rod 44 of circular transverse cross section running longitudinally of the valve body 38. One end of the rod 44 projects from the valve body 38 into the conduit section 24, and such end is formed with a circular disc 46. An annular seal is mounted on the rod 44 between the disc 46 and the valve body 38.

The second end of the rod 44 projects from the valve body 38 towards the outer peripheral surface 34 of the head piece 14, and a pushbutton 48 of circular transverse cross section is affixed to such end of the rod 44. At least a portion of the pushbutton 48 is located externally of the head piece 14. An annular seal is disposed on the rod 44 between the pushbutton 48 and the valve body 38.

The actuating member 42 is movable between an extended position illustrated in FIG. 1 and a depressed position not shown in the drawings. In the extended position, the annular seal adjacent to the disc 46 of the actuating member 42 abuts the end of the valve body 38 facing the conduit section 24 while the annular seal adjacent to the pushbutton 48 is spaced from the valve body 38. On the other hand, in the depressed position, the annular seal adjacent the pushbutton 48 abuts the end of the valve body 38 facing away from the conduit section 24 whereas the annular seal adjacent to the disc 46 is spaced from the valve body 38.

The valve 36 is manually operable in that a user of the container handling device 10 can move the actuating member 42 from the extended position to the depressed position by pushing on the pushbutton 48 with one or more fingers. When the pushbutton 48 is released while in the depressed position, a return biasing element or spring which has not been illustrated for the sake of clarity urges the actuating member 42 back to the extended position.

The valve body 38 has an inlet channel which is not visible in the drawings and extends into the valve body 38 from the end of the valve body 38 facing the conduit section 24. The valve body 38 also has an outlet channel which is not visible in the drawings and extends into the valve body 38 from the end of the valve body 38 facing away from the conduit section 24. When the actuating member 42 is in its extended position, the inlet channel is sealed against the flow of gas therethrough by the annular seal adjacent to the disc 46 of the actuating member 42. On the other hand, the outlet channel establishes a flow path between the conduit section 28 and the end of the valve body 38 which faces away from the conduit section 24, that is, the outlet channel establishes a flow path between the conduit section 28 and the exterior of the head piece 14. In the depressed position of the actuating member 42, the outlet channel is sealed against the flow of gas therethrough by the annular seal adjacent the pushbutton 48 of the actuating member 42. At the same time, the inlet channel establishes a flow path between the conduit section 24 and the conduit section 28.

The connecting piece 18 of the container handling device 10 is here a cylinder of circular transverse cross section having a bore which extends from one end of the cylinder 18 to the other. A portion of the cylinder 18 is located in the recess 20 of the head piece 14, and this portion of the cylinder 18 is fixed to the head piece 14. The portion of the cylinder 18 inside the recess 20 includes one of the ends of the cylinder 18, and this end of the cylinder 18 has an end wall 50 which is adjacent to the end wall 22 of the head piece 14. The end wall 50 of the cylinder 18 is provided with a circular opening which has the same diameter as the conduit section 28 of the head piece 14 and is in register with the conduit section 28.

At the end of the cylinder 18 in the recess 20, the greatest part of the bore in the cylinder 18 is covered by the end wall 50 so that the bore is constricted.

The cylinder 18 has another portion which is located externally of the recess 20 and is exposed, and such portion of the cylinder 18 includes the second end of the cylinder 18. At this exposed end of the cylinder 18, the bore in the cylinder 18 is not constricted.

The tail piece 16 is here in the form of a cylinder of circular transverse cross section. The cylinder 18 bridges the head piece 14 and the tail piece 16, and the tail piece 16 has an end which adjoins and is fixed to the exposed end of the cylinder 18. The tail piece 16 has another end which is spaced from the cylinder 18, and a bore runs from one end of the tail piece 16 to the other and is open at either end of the tail piece 16. The bore in the tail piece 16 is in alignment with the bore in the cylinder 18, and the two bores together define a guide passage 52 in the holder 12. The bores in the tail piece 16 and the cylinder 18 are here of circular transverse cross section and the guide passage 52 accordingly has such a cross section, also.

The tail piece 16 includes a circumferentially complete sealing element 54 at the end of the tail piece 16 remote from the cylinder 18. The guide passage 52 extends through the sealing element 54, and the sealing element 54 circumscribes the passage 52. The sealing element 54 comprises a disc-like, central portion 56 and a circular rim or lip 58 which runs along the outer periphery of the disc-like portion 56. The rim 58 projects from the disc-like portion 56 in a direction away from the cylinder 18.

The tail piece 16 has an outer peripheral surface 60 and is formed with a duct 62 of circular transverse cross section. The duct 62 runs radially of the tail piece 16 between the guide passage 52 and the outer peripheral surface 60. A check valve 64 is located in the duct 62, and the check valve 64 prevents the flow of gaseous fluid into the guide passage 52 while allowing gaseous fluid to flow out of the passage 52. Hence, the duct 62 can be considered an outlet duct.

A second duct 66 in the tail piece 16 runs from the guide passage 52 to the end of the tail piece 16 remote from the cylinder 18. The duct 66, which is again of circular transverse cross section, opens to the guide passage 52 adjacent to the junction of the cylinder 18 and the tail piece 16. A check valve 68 is disposed in the duct 66, and the check valve 68 prevents the flow of gaseous fluid out of the guide passage 52 but permits the flow of gaseous fluid into the passage 52. Accordingly, the duct 66 can be referred to as an inlet duct.

The tail piece 16 has a flat end surface 70 which faces the head piece 14, and the cylinder 18 has an outer peripheral surface 72. The end surface 70, the outer peripheral surface 72 and the annular seal 30 in the conduit section 24 each constitute part of a means for positioning and retaining a cylinder or cartridge 74 of compressed gas on the holder 12. The compressed gas cylinder 74 has an elongated cylinder body 76 which is provided with a neck 78 at one end thereof. When the compressed gas cylinder 74 is properly mounted on the holder 12 as in FIG. 1, the outer peripheral surface of the cylinder body 76 lies against the outer peripheral surface 72 of the cylinder 18 while the end of the cylinder body 76 remote from the neck 78 bears against the flat end surface 70 of the tail piece 16. Furthermore, the neck 78 is received in the passage of the annular seal 30. The annular seal 30 and the neck 78 are in sealing engagement so that gas is unable to flow by the neck 78.

The neck 78 has an end face, and the piercing lance 32 is positioned in such a manner that the lance 32 punctures this end face as the neck 78 is inserted in the annular seal 30 during placement of the compressed gas cylinder 74 on the holder 12. Assuming that the actuating member 42 of the manually operable valve 36 is in its extended position when the compressed gas cylinder 74 is placed on the holder 12, the conduit section 24 of the head piece 14 is pressurized upon puncturing of the end face of the neck 78.

A piston or movable operating element 80 is located in the guide passage 50 of the holder 12. The piston 80 is in the form of a cylinder of circular transverse cross section, and the piston 80 has two axially spaced end surfaces of which one faces the end wall 50 of the cylinder 18 and the other faces away from the end wall 50. The piston 80 is equipped with three annular seals, and one of the seals is located approximately midway between the piston end surfaces. This seal serves as a wiper for lubricant which may be provided in the guide passage 52. A second seal is disposed between the wiper seal and the piston end surface which faces the end wall 50, and this second seal functions to prevent gas flow past the piston 80 in a direction from the second seal towards the wiper seal. The third seal is situated between the wiper seal and the piston end surface facing away from the end wall 50, and the third seal serves to prevent gas flow past the piston 80 in a direction from the third seal towards the wiper seal. The three seals of the piston 80 are spaced from one another axially of the piston 80.

A piston rod 82 of circular transverse cross section projects from the piston end surface which faces away from the end wall 50 of the cylinder 18.

The piston 80 is shiftable along the guide passage 52 of the holder 12 between a rearward position shown in FIG. 1 and a forward position which is not shown in FIG. 1. In the rearward position, the piston 80 is situated adjacent to the end wall 50 of the cylinder 18. A return biasing element which is not illustrated in FIG. 1 for the sake of clarity urges the piston 80 into the rearward position. By way of example, the return biasing element can be a tension spring having one end which is secured to the end wall 50 of the cylinder 18 and another end which is secured to the piston end surface facing the end wall 50.

A needle unit or piercing unit 84 is positioned in the guide passage 52, and the arrangement is such that the piston 80 is located between the needle unit 84 and the end wall 50 of the cylinder 18. The needle unit 84 comprises a cylindrical head 86 of circular transverse cross section which is provided with an annular seal 88. The head 86 is formed with an end surface which faces away from the piston 80, and the needle unit 84 further comprises a needle 90 which projects from this end surface of the head 86. The needle 90 has an end 92 remote from the head 86, and the end 92 is pointed and constitutes a piercing end of the needle 90.

The head 86 is further formed with an end surface which faces the piston 80, and the needle unit 84 is provided with a channel 94 of circular transverse cross section which runs from this end surface to the piercing end 92 of the needle 90. The portion of the channel 94 in the head 86 has a larger diameter than the portion of the channel 94 in the needle 90 and a smaller diameter than the piston rod 82. A check valve 96 is located in the portion of the channel 94 within the head 86, and the check valve 96 prevents the flow of gaseous fluid through the channel 94 in a direction from the piercing end 92 towards the head 86 while allowing the flow of gaseous fluid in the opposite direction.

The head 86 and needle 90 of the needle unit 84 are displaceable along the guide passage 52 of the holder 12 between a retracted position shown in FIG. 1 and an extended position which is not shown in FIG. 1. In the retracted position, the head 86 and needle 90 are located entirely, or almost entirely, inside the guide passage 52 and the head 86 of the needle unit 84 is situated adjacent to the piston rod 82.

The needle unit 84 additionally comprises a guard 98 for the piercing end 92 of the needle 90. The piercing end 92 is embedded in the guard 98 prior to and during insertion of the needle unit 84 in the guide passage 52 and also while the needle unit 84 is in its retracted position within the passage 52. The guard 98 prevents people and objects from being pricked by the piercing end 92.

The guard 98, which consists of a material such as cork penetrable by the needle 90, includes a leg 100 of circular transverse cross section and an annular flange 102 at one end of the leg 100. The leg 100 is receivable in the guide passage 52, and the annular flange 102 sits against the disc-like portion 56 of the sealing element 54 when the leg 100 is properly inserted in the guide passage 52.

The leg 100 is provided with an annular seal 104 which prevents gaseous fluid from flowing past the leg 100 once the leg 100 has been placed in the guide passage 52. The annular seal 104 also serves to firmly seat the leg 100 in the guide passage 52.

One manner of operation of the container handling device 10 is as follows:

If not already present in the guide passage 52, the needle unit 84 is manually pushed into the guide passage 52 so that the annular flange 102 of the guard 98 comes to rest against the disc-like portion 56 of the sealing element 54. The needle unit 84 is now in its retracted position.

With the actuating member 42 of the manually operable valve 36 in its extended position, the compressed gas cartridge 74 is mounted on the holder 12. Thus, the neck 78 of the compressed gas cartridge 74 is pushed into the annular seal 30 in the conduit section 24. Furthermore, the end of the cartridge body 76 remote from the neck 78 is slid along the flat end surface 70 of the tail piece 16 to bring the outer peripheral surface of the cartridge body 76 to rest against the outer peripheral surface 72 of the cylinder 18. As the neck 78 of the compressed gas cartridge 74 enters the annular seal 30, the piercing lance 32 punctures the adjoining end face of the neck 78 thereby pressurizing the conduit section 24. The compressed gas cartridge 74 is advantageously kept upright once the cartridge 74 has been punctured since liquefied gas might otherwise leak out of the cartridge 74.

Figure 2:
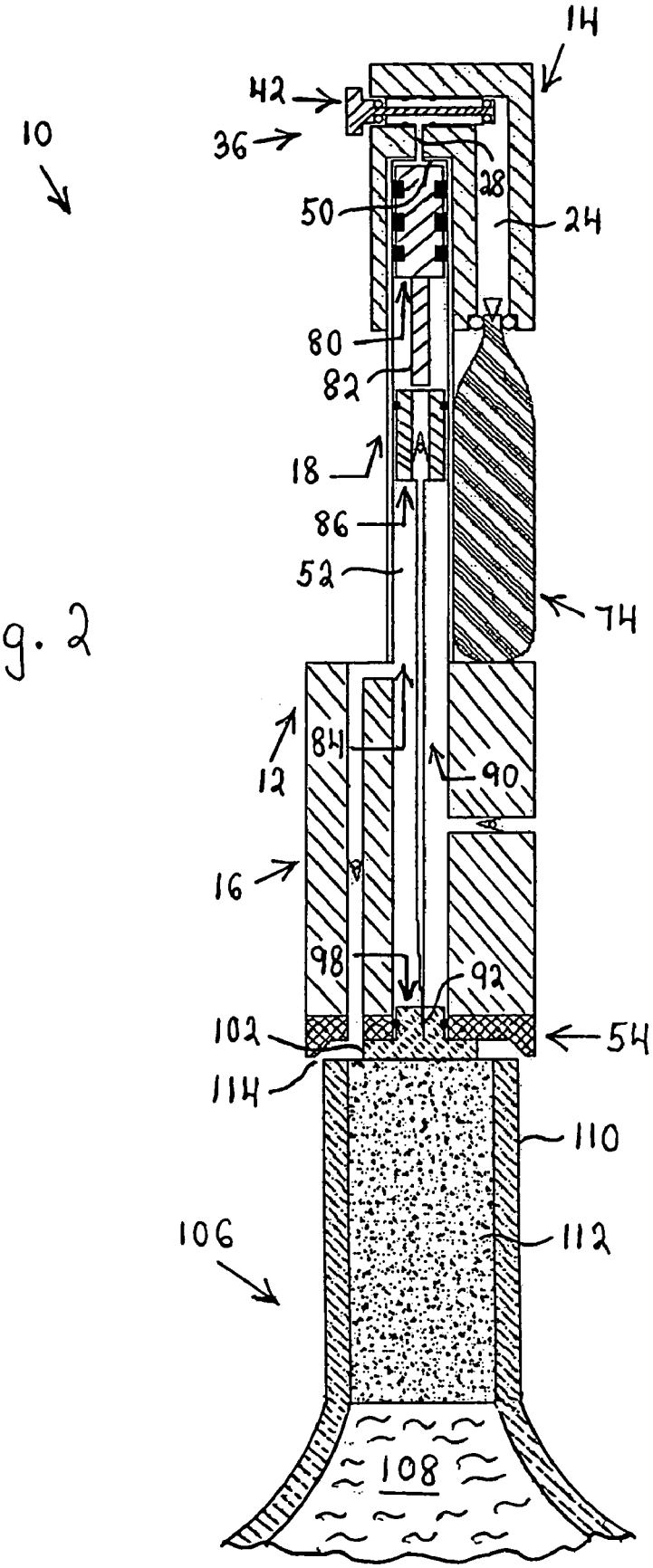
FIG. 2 is similar to FIG. 1 but shows the device in position to pierce a closure of a container shown fragmentarily.

Turning to FIG. 2, the numeral 106 identifies a container which accommodates a body of liquid 108 and has a neck 110 sealed by a closure 112. The container 106 is here assumed to be a wine bottle and the closure 112 is assumed to be a cork.

The container handling device 10 can be used to remove the cork 112 from the wine bottle 106. In order to remove the cork 112, the container handling device 10 is positioned so that the annular flange 102 of the guard 98 lies against the cork 112 approximately centrally of the latter. The annular flange 102 functions as a spacer and causes the sealing element 54 of the tail piece 16 to be separated from the bottle neck 110 and cork 112 by a gap 114.

The annular flange 102 is pressed against the cork 11 2 and the actuating member 42 of the manually operable valve 36 is thereupon pushed to its depressed position. As a result, compressed gas flows from the conduit section 24 into the guide passage 52 via the inlet channel in the manually operable valve 36, the conduit section 28 and the circular opening in the end wall 50 of the cylinder 18. The compressed gas impinges the piston end surface which faces the end wall 50 and forces the piston 80 away from the end wall 50. The piston rod 82, in turn, pushes on the head 86 of the needle unit 84 thereby driving the piercing end 92 of the needle 90 through the guard 98 and into and through the cork 112. The piercing end 92 penetrates the wine bottle 106 as the piercing end 92 passes through the cork 112, and the piercing end 92 is located in the interior of the bottle 106 once the piercing end 92 has traveled completely through the cork 112.

The piston 80 moves from its rearward position to its forward position, and the head 86 and needle 90 move from their retracted position to their extended position, as the piercing end 92 is driven from the guard 98 into the interior of the wine bottle 106. During the operation of forcing the piercing end 92 out of the guard 98 and through the cork 112, the guard 98 serves as a guide for the needle 90.

Figure 3:
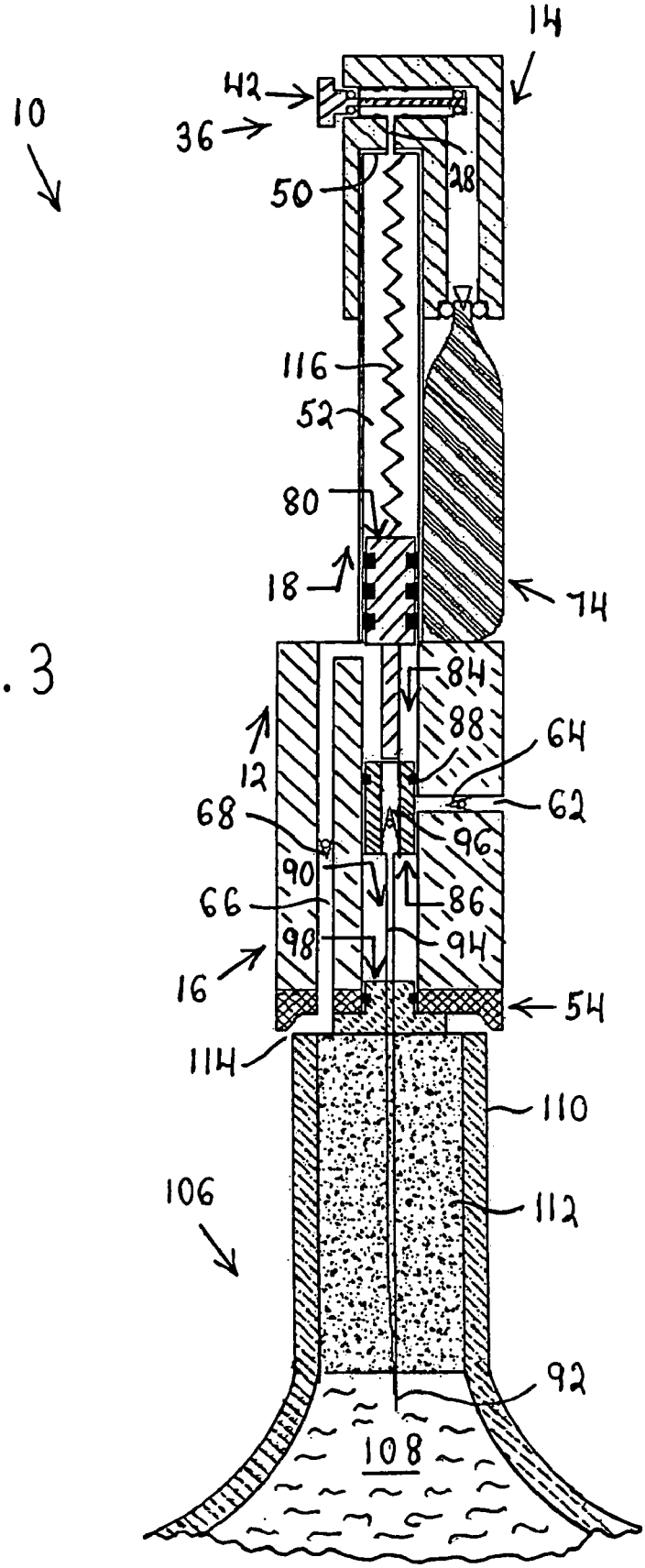
FIG. 3 is similar to FIG. 2 but shows the device and the container following piercing of the closure.

FIG. 3 shows the piston 80 in its forward position, the head 86 and needle 90 in their extended position and the piercing end 92 in the interior of the wine bottle 106. FIG. 3 also shows a return biasing element 116 for urging the piston 80 to its rearward position. The return biasing element 116 is here a tension spring having one end which is secured to the end wall 50 of the cylinder 18 and another end which is secured to the piston end surface facing the end wall 50. Movement of the piston 80 from its rearward position to its forward position takes place against the action of the tension spring 116 which elongates as the piston 80 moves away from its rearward position.

During movement of the head 86 from its retracted position to its extended position, the head 86 forces air out of the portion of the guide passage 52 between the head 86 and the guard 98. The air is evacuated from this portion of the guide passage 52 through the outlet duct 62 of the tail piece 16. Once the head 86 is in its extended position, the annular seal 88 on the head 86 is located between the outlet duct 62 and the piston 80. The annular seal 88 is in sealing engagement with the tail piece 16 and isolates the piston 80 from the outlet duct 62.

After the piston 80 has reached its forward position and the head 86 and needle 90 are in their extended position, the actuating member 42 of the manually operable valve 36 is released and returns to its extended position. Compressed gas no longer flows into the guide passage 52 so that the piston 80 is no longer urged to its forward position. This allows the tension spring 116 to contract and draw the piston 80 to its rearward position.

As the piston 80 returns to its rearward position, the piston 80 forces gas out of the portion of the guide passage 52 between the piston 80 and the end wall 50 of the cylinder 18. This gas is evacuated to the exterior of the head piece 14 through the circular opening in the end wall 50, the conduit section 28 and the outlet channel of the manually operable valve 36.

At the same time that the piston 80 forces gas out of the portion of the guide passage 52 between the piston 80 and the end wall 50, the piston 80 creates a vacuum in the portion of the guide passage 52 between the piston 80 and the head 86 of the needle unit 84. Consequently, air is drawn into the portion of the guide passage 52 between the piston 80 and the head 86. The air flows through the gap 114 between the wine bottle 106 and the sealing element 54 of the tail piece 16 and enters the guide passage 52 via the inlet duct 66 of the tail piece 16. The check valve 96 in the head 86 prevents air from being drawn out of the wine bottle 106 via the channel 94 running through the needle 90 and the head 86.

After the piston 80 is back in its rearward position, the actuating member 42 of the manually operable valve 36 is moved to its depressed position once more. Consequently, the piston 80 is again urged from its rearward position to its forward position by compressed gas from the cartridge 74. During movement of the piston 80 from its rearward position to its forward position, the piston 80 forces the air previously drawn into the guide passage 52 into the interior of the wine bottle 106 through the channel 94 of the needle unit 84. The air flows into the channel 94 because the seal 88 on the head 86 of the needle unit 84 prevents the air from reaching the outlet duct 62 and because the check valve 68 prevents the air from traveling through the inlet duct 66. The air forced into the wine bottle 106 pressurizes the interior of the bottle 106.

When the piston 80 reaches its forward position, the actuating member 42 of the manually operable valve 36 is released thereby permitting the piston 80 to return to its rearward position. If the pressure generated interiorly of the wine bottle 106 is not sufficient to eject the cork 112 from the neck 110 of the bottle 106, the actuating member 42 is moved to its depressed position once more. This enables the piston 80 to force additional air into, and thus increase the pressure in, the wine bottle 106. The process is repeated until the cork 112 is expelled from the wine bottle 106.

Since the wine bottle 106 will typically burst when the pressure inside the bottle 106 reaches a predetermined bursting pressure, it can be desirable to limit the pressure which can be achieved by the piston 80. One way of accomplishing this is through the spring constant of the tension spring 116. In this regard, the total force opposing movement of the piston 80 to its forward position is essentially equal to the force exerted on the piston 80 by the tension spring 116 plus the force exerted on the piston 80 by the pressurized gas in the wine bottle 106. If this total force is increased by increasing the spring constant of the tension spring 116, the pressure which can be achieved by the piston 80 is reduced.

To prevent the wine bottle 106 from bursting during pressurization, it is further possible to replace the check valve 68 in the inlet duct 66 of the tail piece 16 with a valve which functions as both a check valve and a relief valve. When the pressure in the portion of the guide passage 52 between the piston 80 and the head 86 of the needle unit 84 reaches a threshold value below the bursting pressure of the wine bottle 106, the combined check valve and relief valve would open so that air from the guide passage 52 can flow out through the inlet duct 66. This would prevent additional pressurization of the wine bottle 106.

Following expulsion of the cork 112 from the bottle 106, the guard 98 of the needle unit 84 may be removed from the guide passage 52 together with the head 86 and needle 90 of the needle unit 84.

Figure 4:
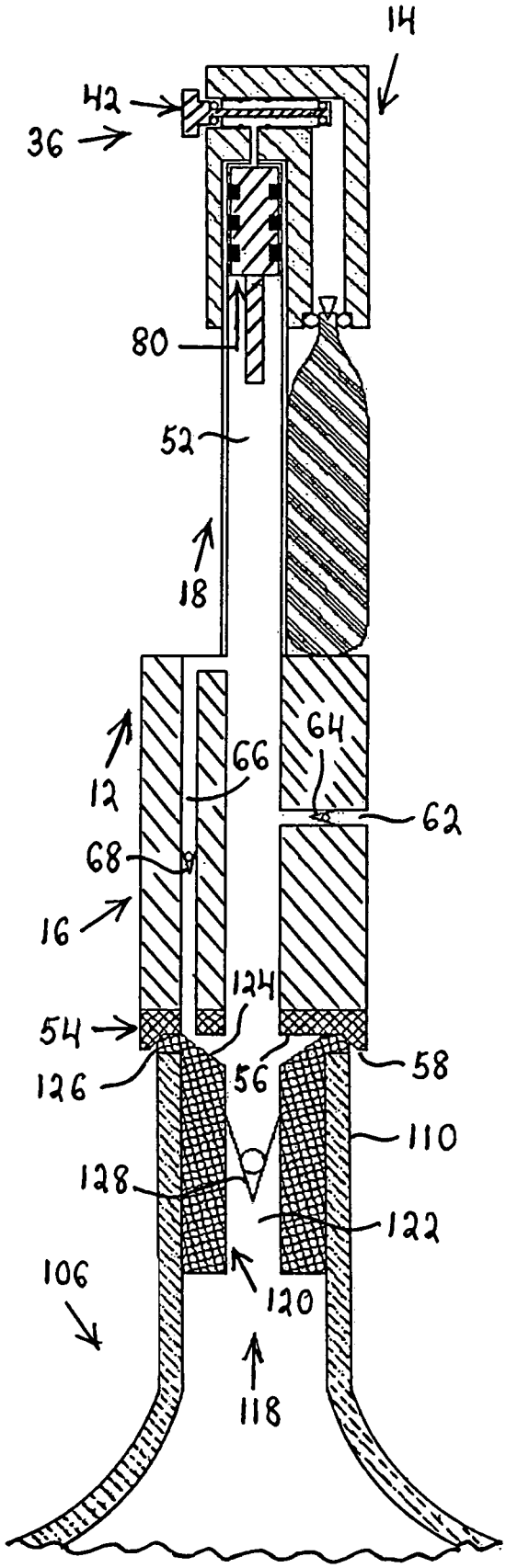
FIG. 4 is similar to FIGS. 2 and 3 but shows the device in position to evacuate the container after removal of the closure.

If only a portion of the wine 108 in the wine bottle 106 is consumed after the cork 112 has been removed and the remainder of the wine 108 is to be stored, a stopper or closure 118 illustrated in FIG. 4 can be inserted in the neck 110 of the wine bottle 106. The stopper 118 includes a cylindrical body 120 having a bore 122 which runs the length of the cylindrical body 120. The cylindrical body 120, which has an annular transverse cross section, includes a funnel-shaped portion 124 at one end thereof. This end of the cylindrical body 120 is provided with an annular flange 126.

The cylindrical body 120 fits snugly in the neck 110 of the wine bottle 106. The neck 110 has an annular end surface which faces away from the interior of the wine bottle 106, and the flange 126 lies against this end surface when the cylindrical body 120 is properly positioned in the neck 110.

A check valve 128 is mounted in the bore 122 of the cylindrical body 120. When the stopper 118 is in the neck 110 of the wine bottle 106, the check valve 128 allows air to flow out of the bottle 106 but prevents air from entering the bottle 106.

The length of time for which the taste, color and aroma of the remaining wine 108 in the wine bottle 106 are preserved can be increased by reducing the amount of oxygen to which the remaining wine 108 is exposed. To this end, it is desirable to evacuate air from the wine bottle 106 after the stopper 118 has been placed in the neck 110 of the bottle 106.

In order to carry out an evacuation of air from the wine bottle 106, the holder 12 of the container handling device 10 is positioned with the annular central portion 56 of the sealing element 54 bearing against the flange 126 of the stopper 118. The rim 58 of the sealing element 54 encircles the flange 126, and the annular central portion 56 and rim 58 of the sealing element 54 are in sealing engagement with the flange 126.

Once the holder 12 is properly seated on the stopper 118, the actuating member 42 of the manually operable valve 36 is moved to its depressed position. Compressed gas flows to the guide passage 52 causing the piston 80 to be urged from its rearward position to its forward position. During movement of the piston 80 from its rearward position to its forward position, the piston 80 forces air out of the guide passage 52 through the outlet duct 62 in the tail piece 16. The check valve 68 in the inlet duct 66 prevents air from flowing through the inlet duct 66 while the check valve 128 in the stopper 118 prevents air from entering the wine bottle 106.

After the piston 80 has reached its forward position, the actuating member 42 of the manually operable valve 36 is released allowing the actuating member 42 to move to its extended position. Compressed gas no longer flows into the guide passage 52 and the tension spring 116 draws the piston 80 back to its rearward position. During movement of the piston 80 towards its rearward position, the piston 80 creates a vacuum in the portion of the guide passage 52 between the piston 80 and the wine bottle 106. As a result, air is drawn out of the wine bottle 106 and into the guide passage 52 through the check valve 128 in the stopper 118. The process is repeated until the tension spring 116 can no longer return the piston 80 to its rearward position. At this time, the wine bottle 106 is evacuated to the maximum extent possible with the tension spring 116. The holder 12 is removed from the wine bottle 106 and the latter is stored.

The vacuum which can be developed in the wine bottle 106 is a function of the spring constant of the tension spring 116, and an increase in spring constant results in a higher vacuum. It is preferred to select the spring constant so that the vacuum does not become excessive.

A certain quantity of oxygen remains in the wine bottle 106 following evacuation thereof with the holder 12 and, in order to further prolong the life of the wine 108 remaining in the bottle 106, it is desirable to reduce the amount of such residual oxygen. To this end, the stopper 118 can include an oxygen scavenger, that is, a material which can react with or bind the residual oxygen. An example of such a material is sulfur dioxide.

The cylindrical body 120 and flange 126 of the stopper 118 can be made from various substances including cork and rubber, and the oxygen scavenger can be incorporated in the substance used to make the cylindrical body 120 and flange 126. The stopper 118 can then continue to remove oxygen from the wine bottle 106 after the latter has been evacuated using the holder 12.

When the wine 108 remaining in the wine bottle 106 is to be consumed, the check valve 128 in the stopper 118 is opened. Air enters the wine bottle 106 and destroys the vacuum therein. The stopper 118 can then be removed from the neck 110 of the wine bottle 106.

From the preceding description of the container handling device 10, it may be seen that the device 10 can be referred to as a device for opening and evacuating containers.

Figure 5:
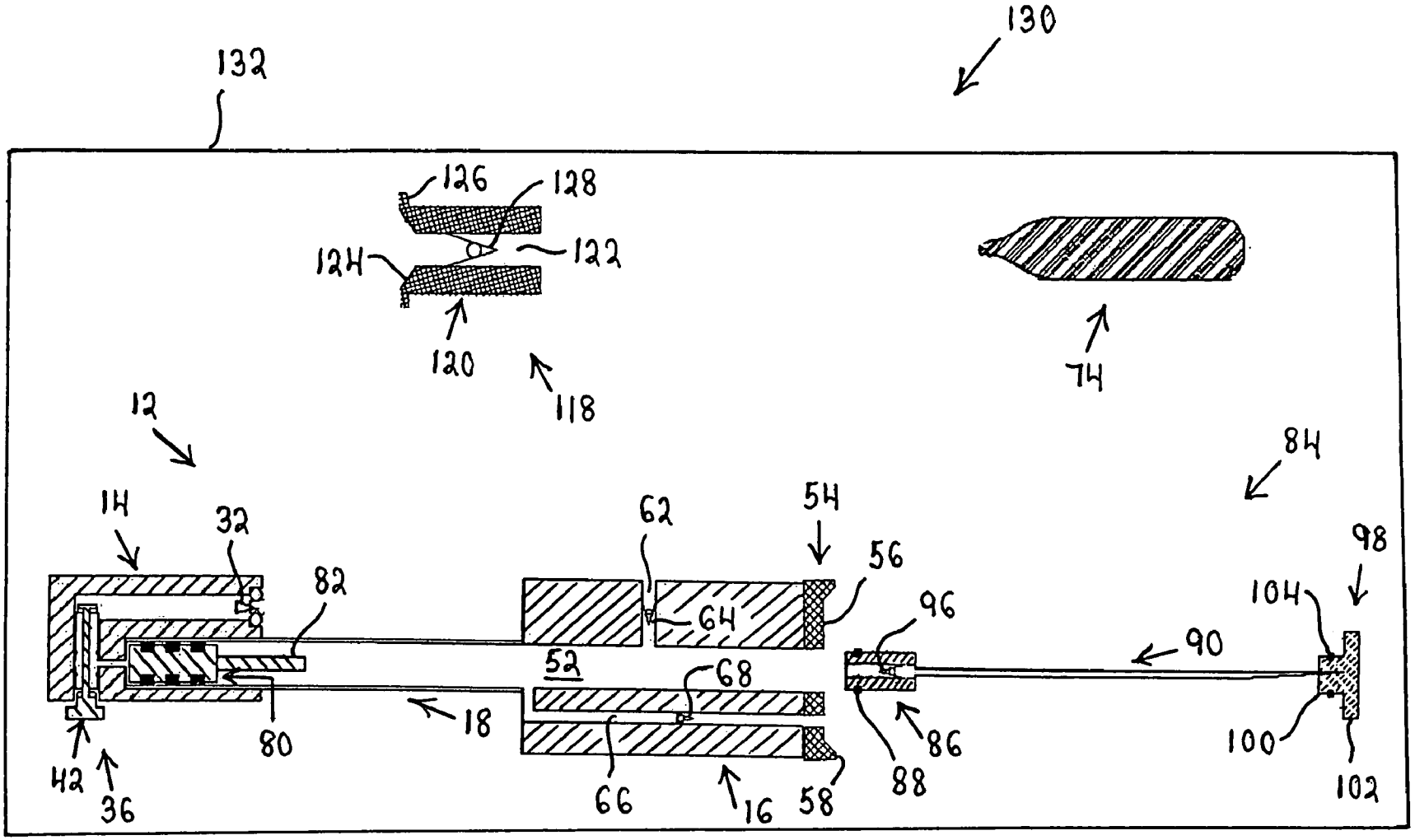
FIG. 5 illustrates a kit containing components of the device of FIG. 1 with the components shown primarily in longitudinal sectional view as in FIG. 1.

Considering FIG. 5, the container handling device 10 can be supplied as a kit 130. The kit 130 comprises packaging 132 enclosing the holder 12, the cartridge 74, the needle unit 84 and the stopper 118. In the kit 130, the cartridge 74 and the needle unit 84 are separated from the holder 12. On the other hand, the manually operable valve 36 is mounted in the conduit section 26 of the holder 12 and the piston 80 with the piston rod 82 is accommodated in the guide passage 52 of the holder 12. Many variations of the kit 130 are possible.

By way of example, the manually operated valve 36 can be the item available from Pneumadyne, Inc. as Part No. C032305. The check valves 64, 68, 96 and 128 can be Model No. 110 of Smart Products, Inc. while the compressed gas cartridge 74 can be Model No. 231B of Crossman, Inc. The compressed gas cartridge 74 typically contains carbon dioxide.

The container handling device 10 employs compressed gas to pass the needle 90 through the cork 112 of the wine bottle 106. This enables the operation of passing the needle 90 through the cork 112 to be accomplished automatically and much more easily than if the operation were carried out by hand.

The seals on the piston 80 prevent compressed gas discharged by the cartridge 74 from reaching the wine bottle 106. This allows non-food grade compressed gas to be used rather than more expensive food grade gas. Moreover, since the compressed gas is unable to enter the wine bottle 106, the compressed gas cannot affect the taste of the wine 108 in the bottle 106.

Various modifications are possible within the meaning and range of equivalence of the appended claims.

We claim:

1. A device for use in handling containers comprising:

a holder provided with a passage;

a piercing element receivable in said passage in a refracted position, said piercing element having a piercing end; and means for driving said piercing element from said retracted position to an extended position in which said piercing end can penetrate a container, said driving means including a movable element for urging said piercing element from said retracted position to said extended position, and said holder being provided with means for positioning and retaining a cartridge of compressed gas on said holder, said holder further being provided with a conduit for conducting compressed gas from the cartridge to said movable element so that the compressed gas can displace said movable element and thereby cause said movable element to shift said piercing element from said retracted position to said extended position.

2. The device of claim 1, wherein said conduit has an open conduit end and said positioning and retaining means includes a seal in the region of said open conduit end for receiving and establishing sealing engagement with an end portion of the cartridge.

3. The device of claim 1, further comprising a puncturing element in said conduit for puncturing the cartridge.

4. The device of claim 1, wherein said movable element is disposed in said passage and is located between said conduit and said piercing element when said piercing element is in said passage, said movable element being provided with sealing means for inhibiting gas flow past said movable element.

5. The device of claim 1, further comprising a manually operable element for controlling gas flow through said conduit, said manually operable element being designed to be switched into and out of a condition in which gas flow from said positioning and retaining means to said movable element is blocked.

6. The device of claim 1, wherein said passage has an open passage end and said piercing element projects through said open passage end in said extended position, said holder being provided with a sealing element which circumscribes said open passage end.

7. The device of claim 1, further comprising a guard for said piercing end, said piercing end being embedded in said guard when said piercing element is in said retracted position.

8. The device of claim 7, wherein said guard comprises means for sealing said passage against gas flow past said guard.

9. The device of claim 1, wherein said piercing element is provided with a channel for conveying gaseous fluid through said piercing element, said channel having an open first channel end in the region of said piercing end, and said channel further having an open second channel end arranged to be located in said passage when said piercing element is in said extended position.

10. The device of claim 9, further comprising a check valve in said channel for inhibiting gas flow in a direction from said first channel end towards said second channel end.

11. The device of claim 9, wherein said holder is provided with an outlet duct for evacuating gaseous fluid from said passage during movement of said piercing element from said refracted position to said extended position, said movable element being designed to force gaseous fluid through said channel when said piercing element is in said extended position, and said piercing element being provided with means for isolating said movable element from said outlet duct when said piercing element is in said extended position.

12. The device of claim 11, further comprising a check valve in said outlet duct for inhibiting gas flow into said passage via said outlet duct.

13. The device of claim 1, wherein said holder is provided with an inlet duct for admitting gaseous fluid into said passage, said movable element being designed to draw gaseous fluid through said inlet duct when said piercing element is in said extended position.

14. The device of claim 13, further comprising a check valve in said inlet duct for inhibiting gas flow out of said passage via said inlet duct.

15. A device for use in handling containers comprising:

a holder provided with a passage, said passage having an open passage end;

a piercing element receivable in said passage in a retracted position, said piercing element being designed so that said piercing element is located in said passage substantially in its entirety when said piercing element is in said retracted position, and said piercing element having a piercing end; and means for driving said piercing element from said retracted position to an extended position in which said piercing element projects from said passage through said open passage end and said piercing end is located externally of said passage to permit penetration of a container by said piercing end;

wherein said piercing element is provided with a channel for conveying gaseous fluid through said piercing element, said channel having an open first channel end in the region of said piercing end, and said channel further having an open second channel end arranged to be located in said passage when said piercing element is in said extended position; and wherein said holder is provided with an outlet duct for evacuating gaseous fluid from said passage during movement of said piercing element from said refracted position to said extended position, said driving means including a movable element designed to force gaseous fluid through said channel when said piercing element is in said extended position, and said piercing element being provided with means for isolating said movable element from said outlet duct when said piercing element is in said extended position.

16. The device of claim 15, wherein said holder is provided with a sealing element which circumscribes said open passage end.

17. The device of claim 15, further comprising a guard for said piercing end, said piercing end being embedded in said guard when said piercing element is in said retracted position.

18. The device of claim 17, wherein said guard comprises means for sealing said passage against gas flow past said guard.

19. The device of claim 15, further comprising a check valve in said channel for inhibiting gas flow in a direction from said first channel end towards said second channel end.

20. The device of claim 15, further comprising a check valve in said outlet duct for inhibiting gas flow into said passage via said outlet duct.

21. The device of claim 15, wherein said holder is provided with an inlet duct for admitting gaseous fluid into said passage, said driving means including a movable element designed to draw gaseous fluid through said inlet duct when said piercing element is in said extended position.

22. The device of claim 21, further comprising a check valve in said inlet duct for inhibiting gas flow out of said passage via said inlet duct.

23. A device for use in handling containers comprising:

a holder provided with a passage, said passage having an open passage end;

a piercing element receivable in said passage in a retracted position, said piercing element being designed so that said piercing element is located in said passage substantially in its entirety when said piercing element is in said retracted position, and said piercing element having a piercing end; and means for driving said piercing element from said retracted position to an extended position in which said piercing element projects from said passage through said open passage end and said piercing end is located externally of said passage to permit penetration of a container by said piercing end;

wherein said driving means includes a movable element for urging said piercing element from said retracted position to said extended position, said holder being provided with means for positioning and retaining a cartridge of compressed gas on said holder, and said holder further being provided with a conduit for conducting compressed gas from the cartridge to said movable element so that the compressed gas can displace said movable element and thereby cause said movable element to shift said piercing element from said retracted position to said extended position.

24. The device or claim 23, wherein said conduit has an open conduit end and said positioning and retaining means includes a seal in the region of said open conduit end for receiving and establishing sealing engagement with an end portion of the cartridge.

25. The device of claim 23, further comprising a puncturing element in said conduit for puncturing the cartridge.

26. The device of claim 23, wherein said movable element is disposed in said passage and is located between said conduit and said piercing element when said piercing element is in said passage, said movable element being provided with sealing means for inhibiting gas flow past said movable element.

27. The device of claim 23, further comprising a manually operable element for controlling gas flow through said conduit, said manually operable element being designed to be switched into and out of a condition in which gas flow from said positioning and retaining means to said movable element is blocked.

28. A kit for use in handling containers comprising:

a holder provided with a passage;

a piercing element receivable in said passage in a retracted position, said piercing element having a piercing end; and means for driving said piercing element from said refracted position to an extended position in which said piercing end can penetrate a container, said driving means including a movable element for urging said piercing element from said retracted position to said extended position, and said driving means additionally including a cartridge for supplying compressed gas to said movable element so as to displace said movable element and thereby cause said movable element to shift said piercing element from said retracted position to said extended position, said holder being provided with means for positioning and retaining said cartridge on said holder, and said holder further being provided with a conduit for conducting compressed gas from said cartridge to said movable element.

29. The kit of claim 28, further comprising a closure for a container, said closure including a body provided with a closure passage, and said closure further including a check valve in said closure passage, said body comprising oxygen-scavenging material.

* * * * *